US005931589A

United States Patent [19]

Kamano et al.

[11] Patent Number: 5,931,589

[45] Date of Patent: Aug. 3, 1999

[54] INK-JET PRINTER HAVING A PRINTING MEDIUM WRAPPING APPARATUS

[75] Inventors: Tadao Kamano; Akira Nuita, both of Shizuoka-ken, Japan

[73] Assignee: Toshiba Tec Kabushiki Kaisha, Tokyo, Japan

[21] Appl. No.: 09/081,508

[22] Filed: May 20, 1998

[30] Foreign Application Priority Data

May 23, 1997 [JP] Japan ..... 9-134118
Jun. 3, 1997 [JP] Japan ..... 9-145354

[51] Int. Cl.[6] ..... B65H 5/06

[52] U.S. Cl. ..... 400/629; 400/624; 347/104; 271/188; 271/277

[58] Field of Search ..... 400/611, 624, 400/629; 271/277, 188; 347/104

[56] References Cited

U.S. PATENT DOCUMENTS

| | | | |
|---|---|---|---|
| 3,648,609 | 3/1972 | Ritzerfeld | 101/471 |
| 3,839,961 | 10/1974 | Murata | 101/415.1 |
| 4,280,693 | 7/1981 | Matsuhisa et al. | 271/246 |
| 4,390,176 | 6/1983 | Kato | 271/270 |
| 4,560,295 | 12/1985 | Fujiwara et al. | 400/637.1 |
| 5,454,319 | 10/1995 | Park et al. | 400/485 |
| 5,771,054 | 6/1998 | Dudek et al. | 347/102 |
| 5,787,330 | 7/1998 | Funato | 399/390 |

FOREIGN PATENT DOCUMENTS

| | | |
|---|---|---|
| 0340925 A2 | 11/1989 | European Pat. Off. . |
| 0664218 A2 | 7/1995 | European Pat. Off. . |
| 54-38813 | 3/1979 | Japan . |
| 55-13912 | 4/1980 | Japan . |

*Primary Examiner*—Edgar Burr
*Assistant Examiner*—Daniel J. Colilla
*Attorney, Agent, or Firm*—Frishauf, Holtz, Goodman, Langer & Chick, P.C.

[57] ABSTRACT

A printing medium winding apparatus includes a drum on a periphery of which a leading-end holding device and a trailing-end engaging groove are provided. The holding device and engaging groove hold and engage with a leading end and trailing end of a printing paper sheet, respectively, when the paper sheet is fed to the drum. The apparatus further includes a paper sheet lifting device which presses the sheet on the periphery of the drum to keep the sheet in close contact with the periphery, and lifts a part of the sheet from the periphery to be curved and projected radially outwardly until the trailing end of the sheet reaches the engaging groove so that the trailing end can be inserted into the engaging groove.

18 Claims, 8 Drawing Sheets

INK-JET PRINTER HAVING A PRINTING MEDIUM WRAPPING APPARATUS

BACKGROUND OF THE INVENTION

The present invention relates to a printing medium winding apparatus for winding a printing medium such as a printing paper sheet having predetermined dimensions around an outer peripheral surface of a rotating drum, while holding the printing medium on the outer peripheral surface of the drum so that a trailing end portion of the printing medium may not float over the outer peripheral surface of the rotating drum, as well as to an ink-jet printer having such a printing medium winding apparatus.

When a printing medium is wound around an outer peripheral surface of a drum, a trailing end portion of the printing medium may often float over the outer peripheral surface of the drum due to a resilient restoration force by which the printing medium curved on the outer peripheral surface of the drum tends to restore to its original flat shape.

If the rotating drum accompanied with the printing medium winding apparatus is used in, for example, an image forming apparatus including a copying apparatus or a printing apparatus and the trailing end portion of the printing medium wound around the outer peripheral surface of the rotating drum floats over the outer peripheral surface of the rotating drum, an image including characters, numerals, symbols, etc., which is to be recorded on the printing medium in the image forming apparatus, may become unclear near the trailing end of the printing medium. In addition, the floating trailing end portion of the printing medium may abut against, or may be caught by, other various members disposed near the outer peripheral surface of the rotating drum. Consequently, the recording apparatus may fail.

Jpn. Pat. Appl. KOKAI Publication No. 54-38813 and Jpn. Pat. Appl. KOKOKU Publication No. 55-13912, for example, already disclose printing medium winding apparatuses capable of preventing a trailing end portion of a printing medium from floating over the outer peripheral surface of the drum. In particular, the above-mentioned KOKAI Publication No. 54-38813 describes that this type of printing medium winding apparatus is used in an ink-jet printer.

In the printing medium winding apparatus described in KOKAI Publication No. 54-38813, a first groove extending in a longitudinal direction of the drum is provided at a predetermined position on the outer peripheral surface of the drum. A printing paper sheet of predetermined dimensions is fed toward the first groove at the predetermined position on the outer peripheral surface of the drum substantially along a tangential line at the predetermined position in a predetermined rotational direction of the drum. A leading end portion of the printing paper sheet is pushed into the first groove by means of a first holding rod extending in the longitudinal direction of the drum. As a result, the leading end portion of the printing paper sheet is held at the predetermined position on the outer peripheral surface of the drum.

If the drum starts to rotate in the predetermined direction, a second holding rod extending in the longitudinal direction pushes the printing paper sheet on the outer peripheral surface of the drum. While the drum makes a first one rotation, the second holding rod prevents an area of the printing paper sheet, which ranges from its leading end portion to the second holding rod, from separating from the outer peripheral surface of the drum. A second groove extending along the first groove is formed at a predetermined position (on the downstream side of the first groove) on the outer peripheral surface of the drum, which is apart from the first groove in a direction opposite to the predetermined rotational direction of the drum. The second holding rod pushes a trailing end portion of the printing paper sheet into the second groove and holds it in the second groove. The combination of the second holding rod and second groove constitutes a trailing end-of-printing medium holding device.

In the printing medium winding apparatus described in the above-mentioned KOKOKU Publication No. 55-13912, a wide groove extending in the longitudinal direction of the drum is provided at a predetermined position on the outer peripheral surface of the drum. A printing paper sheet of predetermined dimensions is fed toward the wide groove at the predetermined position on the outer peripheral surface of the drum substantially along a tangential line at the predetermined position in a predetermined rotational direction of the drum. A leading end portion of the printing paper sheet is clamped on a trailing end portion of the wide groove on the outer peripheral surface of the drum in the predetermined rotational direction by means of a clamp plate which is selectively openable.

If the drum then starts to rotate in the predetermined direction, a push roller pushes the printing paper sheet on the outer peripheral surface of the drum and prevents an area of the printing paper sheet, which ranges between its leading end portion and the push roller, from separating from the outer peripheral surface of the drum while the drum makes first one rotation. In addition, an engaging hook, which can selectively project and retreat, is provided in the wide groove adjacent to a leading edge of the wide groove in the predetermined rotational direction. An engaging hole for engagement with the engaging hook is formed in a trailing end portion of the printing paper sheet. The projecting engaging hook is engaged in the engaging hole in the printing paper sheet pushed on the outer peripheral surface of the drum by means of the push roller. Thereby, the trailing end portion of the printing paper sheet is held on the outer peripheral surface of the drum. The projectable engaging hook and the engaging hole in the trailing end portion of printing paper sheet constitute a trailing end-of-printing medium holding device.

In the printing medium winding apparatus of the above-mentioned Jpn. Pat. Appln. KOKAI Publication No. 54-38813, the rotation of the drum has to be once stopped, each time the leading and trailing end portions of the printing paper sheet are held in the first and second grooves in the outer peripheral surface of the drum by using the first and second holding rods and each time the leading and trailing end portions of the printing paper sheet are separated from the first and second grooves in the outer peripheral surface of the drum. In addition, during a time period between a time when the leading end portion of the printing paper sheet is held in the first groove in the outer peripheral surface of the drum by means of the first holding rod and a time when the trailing end portion of the printing paper sheet is held in the second groove in the outer peripheral surface of the drum by means of the second holding rod, the printing paper sheet is pushed on the outer peripheral surface of the drum by the second holding rod and slid relative to the second holding rod. Consequently, a tensile force is applied to the printing paper sheet on the outer peripheral surface of the drum. The tensile force increases as the rotational speed of the drum increases. This may result in breakage of the leading end portion of the printing paper sheet or breakage of a portion of the paper sheet which is in contact with the second holding rod. Because of this, in an ink-jet printer using the printing medium winding apparatus of KOKAI Publication No. 54-38813, the number of printing paper sheets, on which information can be printed per unit time, cannot be increased.

In the printing medium winding apparatus described in the above-mentioned KOKOKU Publication No. 55-13912, only a special paper sheet having the engaging hole with predetermined dimensions at the predetermined position of the trailing end portion thereof can be used.

The present invention has been made under the above circumstances, and its object is to provide a printing medium winding apparatus capable of exactly holding a trailing end portion of an ordinary printing medium with predetermined dimensions on an outer peripheral surface of a drum at a higher speed than in the prior art, without a need to use a special printing medium, and also to provide an ink-jet printer having such a printing medium winding apparatus, thereby increasing, as compared to the prior art, the number of printing paper sheets on which information can be exactly and clearly printed per unit time.

BRIEF SUMMARY OF THE INVENTION

In order to achieve the object of the invention, there is provided a printing medium winding apparatus comprising:

a drum which has a rotation shaft and is rotatable in a predetermined direction at a predetermined peripheral speed;

a leading-end holding device which is provided at a first position on an outer periphery of the drum and holds at the first position a leading end of a printing medium fed toward the outer periphery of the drum while the drum is rotated;

a trailing-end engaging groove which is provided at a second position on the outer periphery of the drum, the second position being apart from the leading-end holding device in a direction opposite to the predetermined rotational direction of the drum, and extends radially inward of the drum as it progresses from the second position in the direction opposite to the predetermined rotational direction of the drum; and a printing medium lifting device which includes first and second press rollers being able to be in contact and out of contact with the outer periphery of the drum at two mutually circumferentially separated positions on the outer periphery of the drum, the first and second press rollers pressing the printing medium on the outer periphery at the two positions while the leading end of the printing medium is held by the leading-end holding device on the outer periphery of the drum, the second press roller being located away from the first press roller in the direction opposite to the predetermined rotational direction, the printing medium lifting device putting the printing medium in close contact with the outer periphery between the leading-end holding device and the first press roller and lifting the printing medium from the outer periphery of the drum between the first and second press rollers, and a trailing end of the printing medium lifted from the outer periphery of the drum being substantially associated with the trailing-end engaging groove provided at the outer periphery of the drum, wherein the trailing end of the printing medium lifted from the outer periphery of the drum between the first and second press rollers of the printing medium lifting device is inserted in the trailing-end engaging groove at the outer periphery of the drum by an action of the second press roller while the drum is rotated in the predetermined direction.

According to the printing medium winding apparatus having the above structure, without the need to use a special printing medium, a printing medium fed toward the outer periphery of the drum while the drum is rotated is held at its leading end of the printing medium by the leading-end holding device at the first position on the outer periphery of the drum. Following this, while the printing medium is put in close contact with the outer periphery of the drum between the leading-end holding device and the first press roller by the first press roller of the printing medium lifting device, the printing medium is lifted from the outer periphery of the drum between the first and second press rollers, and the trailing end of the printing medium lifted from the center periphery of the drum can be inserted into the trailing-end engaging groove at the second position on the outer periphery of the drum by the action of the second press roller while the drum is rotating.

Therefore, the leading and trailing ends of the ordinary recording medium can be exactly held on the outer periphery of the drum while the drum is rotated at higher speed than in the prior art. Accordingly, the ink-jet printer having this recording medium winding device can exactly form clear images on a greater number of recording media per unit time.

An ink-jet printer having the printing medium winding apparatus with the above structure, comprises:

a drum which has a rotation shaft and is rotatable in a predetermined direction at a predetermined peripheral speed;

a printing medium feeding device which feeds a printing medium toward an outer periphery of the drum while the drum is rotated;

a leading-end holding device which is provided at a first position on the outer periphery of the drum and holds at the first position a leading end of the printing medium fed toward the outer periphery of the drum by the printing medium feeding device while the drum is rotated;

a trailing-end engaging groove which is provided at a second position on the outer periphery of the drum, the second position being apart from the leading-end holding device in a direction opposite to the predetermined rotational direction of the drum, and extends radially inward of the drum as it progresses from the second position in the direction opposite to the predetermined rotational direction of the drum;

a printing medium lifting device which includes first and second press rollers being able to be in contact and out of contact with the outer periphery of the drum at two mutually circumferentially separated positions on the outer periphery of the drum, the first and second press rollers pressing the printing medium on the outer periphery at the two positions while the leading end of the printing medium is held by the leading-end holding device on the outer periphery of the drum, the second press roller being located away from the first press roller in the direction opposite to the predetermined rotational direction, the printing medium lifting device putting the printing medium in close contact with the outer periphery between the leading-end holding device and the first press roller and lifting the printing medium from the outer periphery of the drum between the first and second press rollers, a trailing end of the printing medium lifted from the outer periphery of the drum being substantially associated with the trailing-end engaging groove provided at the outer periphery of the drum, and the trailing end of the printing medium lifted from the outer periphery of the drum between the first and second press rollers being inserted in the trailing-end engaging groove at the outer periphery of the drum by an action of the second press roller while the drum is rotated in the predetermined direction;

an ink-jet device which forms an image on the printing medium while the leading and trailing ends of the printing medium are held by the leading-end holding device and the trailing-end engaging groove on the outer periphery of the drum, the printing medium is put in close contact with the outer periphery of the drum, and the drum is rotated in the predetermined direction;

a removing device which removes the printing medium from its leading end to its trailing end from the outer periphery of the drum immediately under the condition that the image has been formed on the printing medium by the ink-jet printer and the holding of the leading end of the printing medium by the leading-end holding device has been released; and a printing medium discharge device which discharges the printing medium removed from the outer periphery of the drum by the removing device, to a predetermined position being independent of the drum.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

An ink-jet printer having a printing medium winding device according to an embodiment of the invention and a modification of the printing medium winding apparatus of the embodiment will now be described in detail with reference to the accompanying drawings.

DETAILED DESCRIPTION OF THE INVENTION

Figure 1:
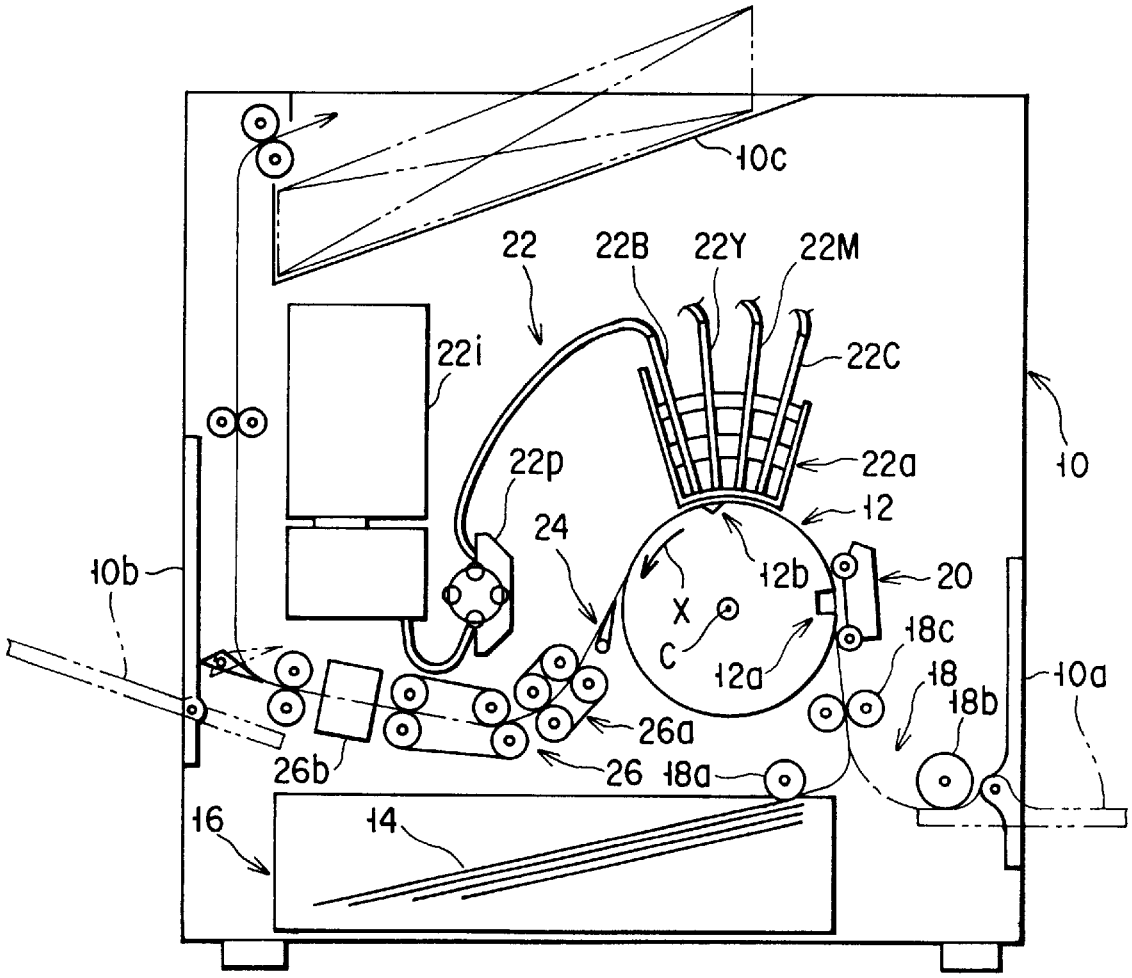
FIG. 1 is a schematic cross-sectional view of an ink-jet printer having a printing medium winding apparatus according to an embodiment of the present invention.

The structure of an ink-jet printer having a printing medium winding apparatus according to an embodiment of the present invention will now be described with reference to FIG. 1. FIG. 1 is a schematic cross sectional view of the ink-jet printer having the printing medium winding apparatus according to the embodiment.

The ink-jet printer shown in FIG. 1 uses, as a printing medium, a printing paper sheet with predetermined dimensions. A printing paper manual feed tray 10*a* is openably provided on a right side wall of an outer housing 10 of the ink-jet printer. A printing paper discharge auxiliary tray 10*b* is openably provided on a left side wall of the housing 10*a*. A printing paper discharge main tray 10*c* is provided on a top wall of the housing 10*a*. A drum 12 rotatable in a predetermined direction indicated by an arrow X is disposed in a region within the outer housing 10 between the manual feed tray 10*a* on the right side wall and the printing paper discharge auxiliary tray 10*b* on the left side wall. A printing paper cassette 16 containing a batch of printing paper sheets 14 with predetermined dimensions is detachably provided at a predetermined position below the drum 12.

A printing paper feeder 18 is provided within the housing 10 in an area surrounded by a region which is located around the drum and faces the right side wall of housing 10, the manual feed tray 10*a* and the printing paper cassette 16. The printing paper feeder 18 is used for feeding a printing paper sheet at a predetermined timing from the manual feed tray 10*a* or printing paper cassette 16 to the right side wall facing region around the drum 12. A trailing-end holding device 20 is provided in the right side wall facing region around the drum 12 within the housing 10. An ink-jet nozzle unit 22*a* of an ink-jet device 22 is provided in a region which is located around the drum 12 and faces the top wall of housing 10. A removing device 24 is provided in a region which is located around the drum 12 and faces the left side wall of housing 10.

The ink-jet nozzle unit 22*a* comprises nozzle bodies 22C, 22M, 22Y and 22B arranged at four circumferential positions separated from each other at predetermined intervals in a predetermined rotational direction X of the drum 12. Each of the nozzle bodies 22C, 22M, 22Y and 22B extends in a direction (longitudinal direction) along a rotation center line c of a rotation shaft of the drum 12, and a number of ink nozzles (not shown) separated at predetermined intervals along the aforementioned longitudinal direction are provided on a distal end of each of the nozzle bodies.

A proximal end of each of the four nozzle bodies 22C, 22M, 22Y and 22B of ink-jet nozzle unit 22*a* is connected to an associated detachable ink cartridge 22*i* through an ink supply pump 22*p*. The nozzle body 22C located on the most upstream side in the rotational direction X of drum 12 is connected to the ink cartridge 22*i* containing a cyan color ink. The nozzle body 22M located adjacent to the nozzle body 22C in the rotational direction X of drum 12 is connected to the ink cartridge 22*i* containing a magenta color ink. The nozzle body 22Y located adjacent to the nozzle body 22M in the rotational direction X of drum 12 is connected to the ink cartridge 22*i* containing an yellow color ink. The nozzle body 22B located adjacent to the nozzle body 22Y in the rotational direction X of drum 12 is connected to the ink cartridge 22*i* containing a black color ink.

A leading-end holding device 12*a* is provided at a predetermined first position on the outer periphery of drum 12. The leading-end holding device 12*a* is used for holding a leading end of printing paper sheet 14 fed to the predetermined first position on the outer periphery of drum 12 at a predetermined timing by the printing paper feeder 18. A trailing end engaging groove 12*b* is provided at a predetermined second position on the outer periphery of drum 12. The trailing end engaging groove 12 is used for engaging with a trailing end of printing paper sheet 14 the leading end of which have been held by the leading-end holding device 12*a* on the outer periphery of drum 12.

A printing paper discharge device 26 is provided in an area within the housing 10, the area being surrounded by the removing device 24, the discharge auxiliary tray 10*b* at the left side wall and the discharge main tray 10*c* at the top wall. The printing paper discharge device 26 is used for selectively discharging the printing paper sheet 14 from the removing device 24 to the printing paper discharge auxiliary tray 10*b* at the left side wall or printing paper discharge main tray 10*c* at the top wall.

A power switch, various operation buttons and an information display device (all not shown) are provided on an upper surface of the top wall of outer housing 10.

In the ink-jet printer having the above structure, the batch of printing paper sheets 14 in the cassette 16 are placed on a pushing plate (not shown). The pushing plate is urged upward by urging means (not shown) such as a compression coil spring. If the printing paper cassette 16 is situated in a predetermined position below the drum 12 within the housing 10, an uppermost printing paper sheet 14 in the batch of printing paper sheets 14 is put in contact with a pickup roller 18*a* of the printing paper feeder 18.

When the power switch (not shown) has been turned on, a control unit (not shown) of the ink-jet printer receives image data from a host equipment (not shown) such as a computer connected to the printer and the printing paper manual feed tray 10*a* is set in a closed position indicated by a solid line in FIG. 1, the uppermost printing paper sheet of the batch of printing paper sheets 14 in the cassette 16 is sent out from the cassette 16 by the pickup roller 18*a*. The sent-out printing paper sheet 14 is then guided by means a guide plate (not shown) of feeder 18 to the trailing-end holding device 20 in the right side wall facing region around the drum 12. In the same situation but excluding that the manual feed tray 10*a* is set in the open position indicated by a two-dot-and-dash line in FIG. 1, a printing paper sheet with predetermined dimensions manually placed on the manual feed tray 10*a* is sent out by an auxiliary pickup roller 18*b* included in the printing paper feeder 18 and disposed near an inner end of the manual feed tray 10*a*. The sent-out paper sheet is then guided by means the guide plate (not shown) of feeder 18 to the trailing-end holding device 20 in the right side wall facing region around the drum 12.

At this time, the drum 12 starts to rotate at a predetermined speed in the predetermined direction X.

The printing paper feeder 18 includes a wait roller pair 18*c* disposed at an exit of the guide plate (not shown). A leading end of printing paper sheet 14, which has reached the exit of the guide plate (not shown) from the printing paper cassette 16 or manual feed tray 10*a*, comes in contact with a contact line between the paired wait rollers 18*c*. At this time, the movement of the printing paper sheet 14 is once stopped and a skew thereof is corrected. The wait roller pair 18*c* sends out the printing paper sheet 14 toward the leading-end holding device 12*a* in a direction of movement of the holding device 12*a* at a speed slightly higher than the circumferential speed of the outer periphery of drum 12 at a predetermined timing at which the leading-end holding device 12*a* provided at the predetermined first position on the periphery of drum 12 passes by the vicinity of wait roller pair 18*c*.

The leading-end holding device 12*a* thus holds the leading end of printing paper sheet 14 supplied from the wait roller pair 18*c* of printing paper feeder 18. The structure and operation of the leading-end holding device 12*a* will be described later in detail with reference to FIGS. 2 to 4.

Before the leading-end holding device 12*a* has passed under the trailing-end holding device 20 or immediately after the leading end of printing paper sheet 14 has been held by the leading-end holding device 20, the trailing-end holding device 20 presses the paper sheet 14 on the periphery of drum 12 and winds the paper sheet 14 around the periphery of drum 12 while the drum 12 makes one rotation. During this time, the trailing-end holding device 20 puts a portion of printing paper sheet 14, which extends between the leading-end holding device 12*a* and the trailing-end holding device 20, in close contact with the periphery of drum 12. In addition, another portion of the printing paper 14, which corresponds to the trailing-end holding device 20, is curved and lifted from the periphery of drum 12. Since a trailing end of paper sheet 14, whose leading end is held as described above, corresponds to the trailing-end engaging groove 12*b* on the periphery of drum 12 (that is, since a distance between the leading-end holding device 12*a* and the trailing-end holding device 20 along the periphery of the drum 12, as measured in a direction opposite to the predetermined rotational direction X of drum 12, is substantially equal to a distance between the leading end and the trailing end of printing paper sheet 14 whose leading end is held as described above), the curved portion of printing paper sheet 14 extends along the periphery of drum 12 when the trailing end of printing paper sheet 14 passes under a part or substantially whole of the trailing-end holding device 20. Thus, the trailing end of curved printing paper sheet 14 is inserted into and engaged with the trailing end engaging groove 12*b* provided at the predetermined second position on the outer periphery of drum 12. As a result, the paper sheet 14 is held in contact with the outer periphery of drum 12 while the leading end of printing paper sheet 14 is held by the leading-end holding device 12*a* and the trailing end of paper sheet 14 is engaged in the groove 12*b*. The trailing-end holding device 20 is separated from the outer periphery of drum 12 immediately after the trailing end of printing paper sheet 14 has passed under the portion or substantially whole of the trailing-end holding device 20 and has been inserted in the engaging groove 12*b*, or when a predetermined time have passed after the trailing end of printing paper sheet 14 has been inserted in the engaging groove 12*b*.

The structures and operations of the trailing-end engaging groove 12*b* and trailing-end holding device 20 will be described later in detail with reference to FIGS. 5 through 9H.

Then, after one rotation of the drum 12 for winding the printing paper sheet 14 around the outer periphery of drum 12 is completed as described above, subsequent rotation of drum 12 is started to print an image on the printing paper sheet 14 by means of the ink-jet device 22. An image to be printed includes characters, numerals, symbols, etc.

The ink-jet apparatus 22 requires one rotation of drum 12 to print an image on the printing paper sheet 14, even to print a full-color image by using all the four nozzle bodies 22C, 22M, 22Y and 22B of ink-jet nozzle unit 22*a* of ink-jet apparatus 22.

After the printing of an image using desired colors on the paper sheet 14 is finished, that is, after one rotation of the drum 12 for the image printing is completed, the drum 12 makes an extra one rotation to remove the paper sheet 14 on which the image have been printed from the drum 12. During the extra one rotation, the leading-end holding device 12*a* of the drum 12 releases the leading end of printing paper sheet 14 when the leading-end holding device 12*a* has approached the removing device 24, and at the same time the removing device 24 removes the printing paper sheet 14 from the periphery of the drum 12 from its leading end. The removing device 24 includes a removing plate which is selectively put in contact with the periphery of drum 12.

After the printing paper sheet 14 on which the image has been formed is removed from the periphery of drum 12 by the removing device 24, the drum 12 stops its rotation if there is no additional printing paper sheet 14 on which an image is to be formed. If there is an additional paper sheet 14 on which an image is to be formed, the drum 12 makes additional three rotations the first rotation of which is for winding the additional printing paper sheet 14 around the periphery of drum 12, the second rotation of which is for forming the image on the wound additional paper sheet 14 and the third rotation of which is for removing the paper sheet 14 on which the image has been formed from the periphery of drum 12.

The printing paper sheet 14 removed from the periphery of drum 12 is discharged by the printing paper discharge device 26 selectively to the printing paper discharge auxiliary tray 10*b* provided on the left side wall of the outer housing 10 or to the printing paper discharge main tray 10*c* provided on the top wall of housing 10. More specifically, the discharge device 26 includes a printing paper discharge guide unit 26*a* extending from the removing device 24 through the discharge auxiliary tray 10*b* to the discharge main tray 10*c*. The printing paper discharge guide unit 26*a* has a plurality of guide rollers and guide belts hung between some of these guide rollers. When the discharge auxiliary tray 10*b* is set in the closed position indicated by the solid line in FIG. 1, the guide unit 26*a* guides the printing paper 14 from the removing device 24 to the discharge main tray 10*c*. When the discharge auxiliary tray 10*b* is set in the open position indicated by the two-dot-and-dash line in FIG. 1, the guide unit 26*a* guides the printing paper 14 from the removing device 24 to the auxiliary tray 10*b*.

The printing paper discharge device 26 of the inkjet printer according to this embodiment includes an ink dryer 26*b* disposed just before the discharge auxiliary tray 10*b* along the printing paper discharge guide unit 26*a*.

The structural elements of the leading-end holding device 12*a* and their operations will now be described in detail with reference to FIGS. 2 to 4.

Figure 2:
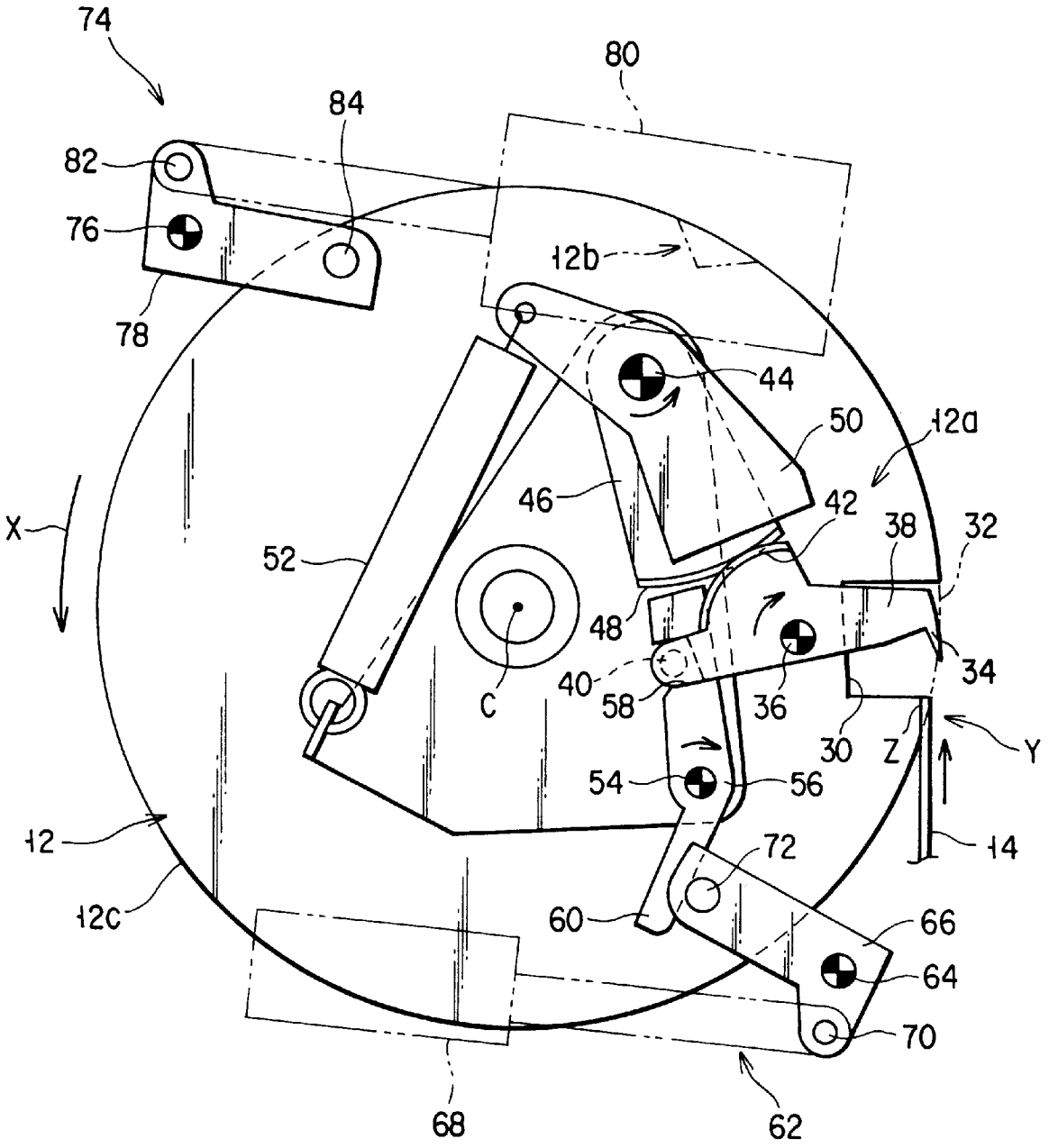
FIGS. 2, 3 and 4 are enlarged schematic side views of a drum and a leading-end holding device at a first position of the outer periphery of the drum in various states of an operation of the leading-end holding device, the drum and the holding device being included in the printing medium winding apparatus according to the embodiment of the invention.

FIG. 2 is a schematic side view showing a state of the leading-end holding device 12*a*, in which the printing paper sheet 14 is fed from the wait roller pair 18*c* of printing paper feeder 18 towards the right side wall facing region (indicated by an arrow Y in FIG. 2) around the rotary drum 12 at a speed slightly higher than the predetermined circumferential speed of the periphery of drum 12 in the predetermined direction X at a timing at which the leading-end holding device 12*a* formed at the predetermined first position (indicated by reference symbol Z in FIG. 2) on the periphery of drum 12 reaches the right side wall facing region Y around the periphery 12*c* of rotary drum 12, and the leading end of the paper sheet 14 has not been held by the leading-end holding device 12*a*. FIG. 3 is a schematic side view showing a state in which the leading end of the printing paper sheet 14 fed to the right side wall facing region Y around the periphery of drum 12 has just been held by the leading-end holding device 12*a*. FIG. 4 is a schematic side view showing a state in which the holding of the leading end of printing paper sheet 14 by the leading-end holding device 12*a* on the periphery of drum 12 will soon be released.

A recess 30 is formed at a portion located just before the predetermined second position Z on the outer periphery 12*c* of the rotary drum 12 in the rotation direction X of the drum 12. The recess 30 extends along and in parallel to the rotation center line C of the rotation shaft of the rotary drum 12. The predetermined first position Z includes a band-like portion at a trailing edge of the recess 30 in the periphery 12*c* of the drum 12 in the rotation direction X of the rotary drum 12. The rotary drum 12 is smaller in the radius at the first position Z than at the other of the periphery 12*c*. This is obvious from that, the first position Z is located inwardly of a circular arc 32 which extends over the recess 30 from a leading edge of the recess 30 to a trailing edge thereof in the direction opposite to the rotation direction X of the drum 12.

The leading-end holding device 12*a* includes a leading-end holding hook 34 extending along the recess 30. The leading-end holding hook 34 is integrally formed on one end portion of a swing member 38 which is swingably mounted by a pivot pin 36 on both side surfaces of the rotary drum 12. As the swing member 38 swings on the pivot pin 36, the leading-end holding hook 34 is moved between a release position and an overlap position. In the release position, the hook 34 is spaced from the first position Z on the outer periphery 12*c* of the rotary drum 12 in the rotation direction X of the drum 12. And, in the overlap position the hook 34 is moved from the release position in the direction opposite to the rotation direction X of the drum 12 and overlaps over the first position Z. The other end of the swing member 38 is provided with an engaging pin 40 and a sector gear 42 arranged coaxially to the pivot pin 36.

In addition, a sub-swing member 46 is pivotably mounted by a pivot pin 44 on one side surface of the rotary drum 12. On end portion of the sub-swing member 46 is provided with a sector gear 48 arranged coaxially to the pivot pin 44. The sector gear 48 of the subswing member 46 is engaged with the sector gear 42 of the swing member 38. A cam member 50 is connected to the pivot pin 44 so that the can member 50 swings, together with the sub-swing member 46. One end portion of the cam member 50 projects outward from the one end portion of the sub-swing member 46 in the radial direction of the drum 12. The other end of the cam member 50 is connected to an urging member 52 such as a tension coil spring which is connected to the side surface of the rotary drum 12. By the action of the urging member 52 through the engagement between the sector gear 48 of the sub-swing member 46 and the sector gear 42 of the swing member 38, the leading-end holding hook 34 is urged from the release position shown in FIG. 2 in the direction opposite to the rotation direction X of the drum 12, towards the overlap position.

In addition, an engaging lever 56 is pivotably mounted by a pivot pin 54 on the side surface of the rotary drum 12 at a position opposite to the sub-swing member 46 about the swing member 38. The engaging lever 56 has an engaging recess 58 provided in one end thereof to engage with the engaging pin 40 of the swing member 38.

When the leading-end holding hook 34 is located at the release position as shown in FIG. 2, the engaging lever 56 is located at its engaging position at which its engaging recess 58 is engaged with the engaging pin 40 of the swing member 38, thus the leading-end holding hook 34 is locked at the release position shown in FIG. 2 against the force of the urging member 52.

The engaging lever 56 is also urged to the engaging position by an urging member not shown. When the leading-end holding hook 34 is located at the release position, the distal end of the holding hook 34 projects outward in the radial direction of the rotary drum 12 from the circular arc 32 extending over the recess 30, and the proximal end of the holding hook 34 is retracted radially inwardly from the circular arc 32.

The other end of the engaging lever 56 extends outwardly in the radial direction of the rotary drum 12, and forms a cam member 60.

A lock release mechanism 62 is mounted at a position located near to the side surface of the rotary drum 12 and is separated from the predetermined right sidewall facing region Y around the periphery 12*c* of the drum 12 in the direction opposite to the rotation direction X of the drum 12. The release mechanism 62 is used to selectively release the engagement of the engaging lever 56 with the swing member 36. The lock release mechanism 62 comprises a drive lever 66 and a known actuator 68. The drive lever 66 is pivotably mounted by a pivot pin 64 on the housing 10 (FIG. 1) at a position located near to one side surface of the drum 12 and separated from the right side wall facing region Y around the rotary drum 12 in the direction opposite to the predetermined rotation direction X of the drum 12. The known actuator 68 is mounted on the housing 10 (FIG. 1) at a position located near to one side surface of the rotary drum 12 and is separated from the drive lever 66 in the opposite direction. The actuator 68 is linked by a link pin 70 to one end of the drive lever 66. The other end of the drive lever 66 is provided with an engaging pin 72. The actuator 68 selectively drives the drive lever 66 so that the other end of the drive lever 66 moves between an operating position (FIGS. 2 and 3) and a rest position (FIG. 4). In the operating position, the other end of the drive lever 66 projects into a locus of the cam member 60 of the engaging lever 56 produced by the rotation of the rotary drum 12 while the engaging lever 56 is arranged in the engaging position as shown in FIG. 2. And in the rest position, the other end of the drive lever 66 is retracted radially outwardly from the locus of the cam member 60. In the operation position, the engaging pin 72 of the drive lever 66 engages with the cam member 60 of the other end of the engaging lever 56 while the drum 12 in rotated in the predetermined direction X and the engaging lever 56 is located in the engaging position shown in FIG. 2.

Moreover, a lock reset mechanism 74 is mounted at a position located near to the side surface of the rotary drum 12 and separated from the predetermined right side wall facing region Y around the periphery 12*c* of the drum 12 in the rotation direction X of the drum 12. The lock reset mechanism 74 is used to selectively drive the cam member 50 to reset the engagement of the engaging lever 56 with the swing member 38 through the sub-swing member 46. The lock reset mechanism 74 is similar in construction to the lock release mechanism 62, and comprises a drive lever 78 and a known actuator 68. The drive lever 78 is pivotably mounted by a pivot pin 76 on the housing 10 (FIG. 1) at a position located near to the side surface of the drum 12 and separated from the removing device 24 shown in FIG. 1 in the direction opposite to the rotation direction X of the rotary drum 12. The known actuator 68 is mounted on the housing 10 (FIG. 1) at a position located between the removing device 24 and the predetermined right side wall facing region Y around the periphery of the rotary drum 12. The actuator 80 is linked by a link pin 82 to one end of the drive lever 78. The other end of the drive lever 78 is provided with an engaging pin 84. The actuator 80 selectively drives the drive lever 78 so that the other end of the drive lever 78 moves between an operation position (FIG. 4) and a rest position (FIGS. 2 and 3). In the operation position, the other end of the drive lever 78 projects into a locus of the cam member 50 produced by the rotation of the rotary drum 12 while the cam member 50 is arranged in a projecting position (FIGS. 3 and 4). And in the rest position, the other end of the drive lever 78 is retracted radially outward from a locus of the cam member 50 produced by the rotation of the rotary drum 12 while the cam member 50 is arranged in a retracted position (FIG. 2). The engaging pin 84 of the other end of the drive lever 78 engages with the cam member 50 while the drum 12 is rotated in the predetermined direction X and the cam member 50 is located in the projecting position shown in FIGS. 3 and 4.

A leading-end holding action and leading end releasing action of the leading-end holding device 12*a* structured a described above will now be described in detail further with reference to FIGS. 2 to 4.

The actuator 68 of the lock release mechanism 62 drives the drive lever 66 to the operating position shown in FIG. 2 before the leading-end holding hook 34 comes to the right side wall facing region (that is, the specific region) Y around the outer periphery 12*c* of the rotary drum 12 as shown in FIG. 2 while the drum 12 is rotated in the predetermined direction X at the predetermined circumferential speed and the engaging lever 56 is located in the engaging position shown in FIG. 2. While the drive lever 66 is located at the operating position, the cam member 60 of the other end of the engaging lever 56 in the engaging position strikes the engaging pin 72 on the other end of the drive lever 66 and the engaging lever 56 is driven to turn about the pivot pin 54 (clockwise in FIG. 2) against the force of the urging member not shown. Accordingly, the engagement of the engaging recess 58 of the engaging lever 56 with the engaging pin 40 of the swing member 38, and the swing member 38 is urged by the force of the urging member 52 to be moved from the release position shown in FIG. 2 to the overlap or close position.

Figure 3:
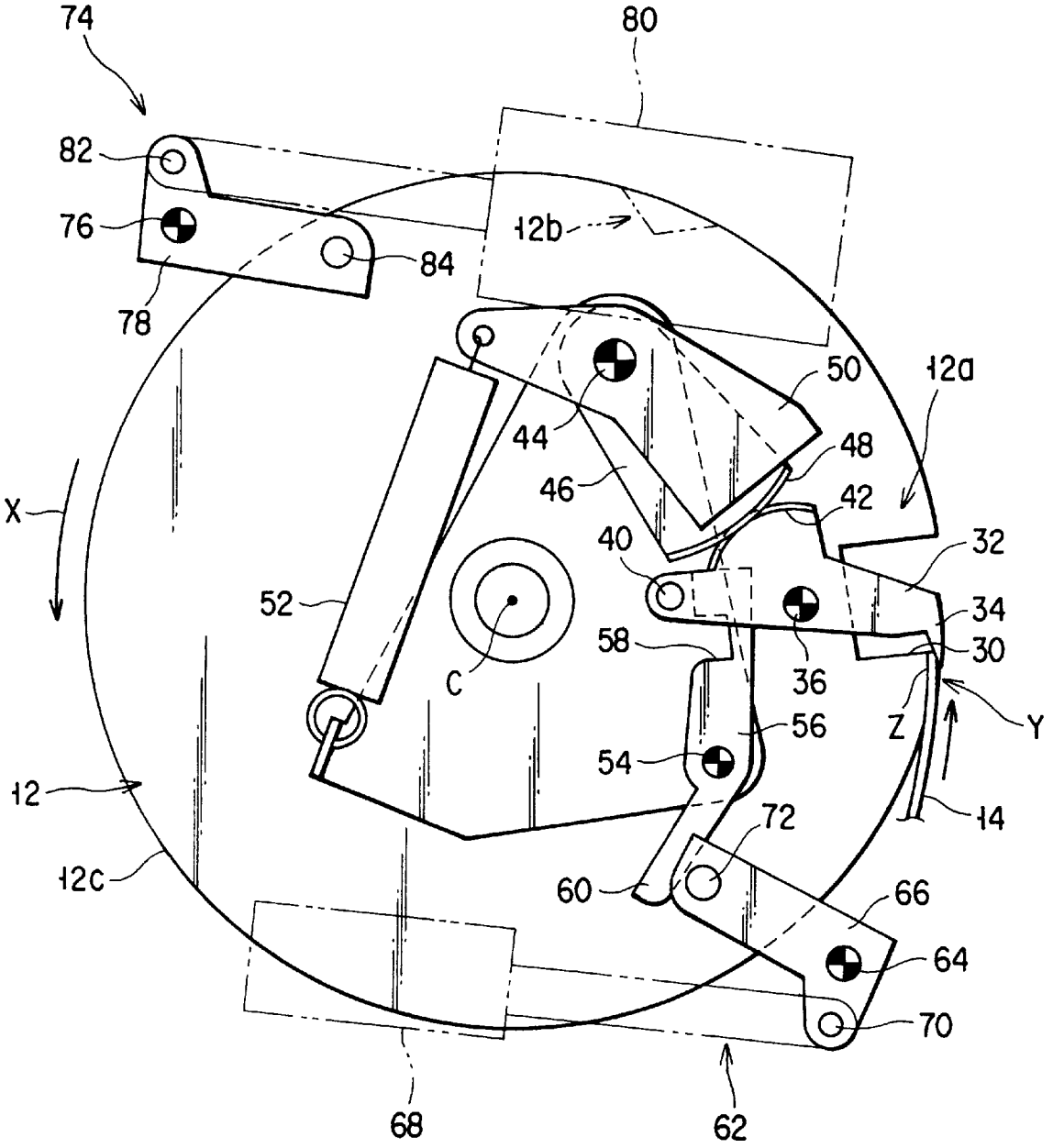

Since the printing paper sheet 14 is fed at the slightly higher speed than the circumferential speed of the periphery 12*c* of the rotary drum 12 from the wait roller paper 18*c* toward the specific region Y around the periphery 12*c* of the drum 12 at the above described predetermined timing, the leading end of the paper sheet 14 is pressed on the first position Z on the periphery 12*c* of the rotary drum 12 by the leading-end holding hook 34 moved from the release position (FIG. 2) to the overlap position (FIGS. 3 and 4) and is held by the first position Z and the leading-end holding hook 34 as shown in FIG. 3.

Figure 4:
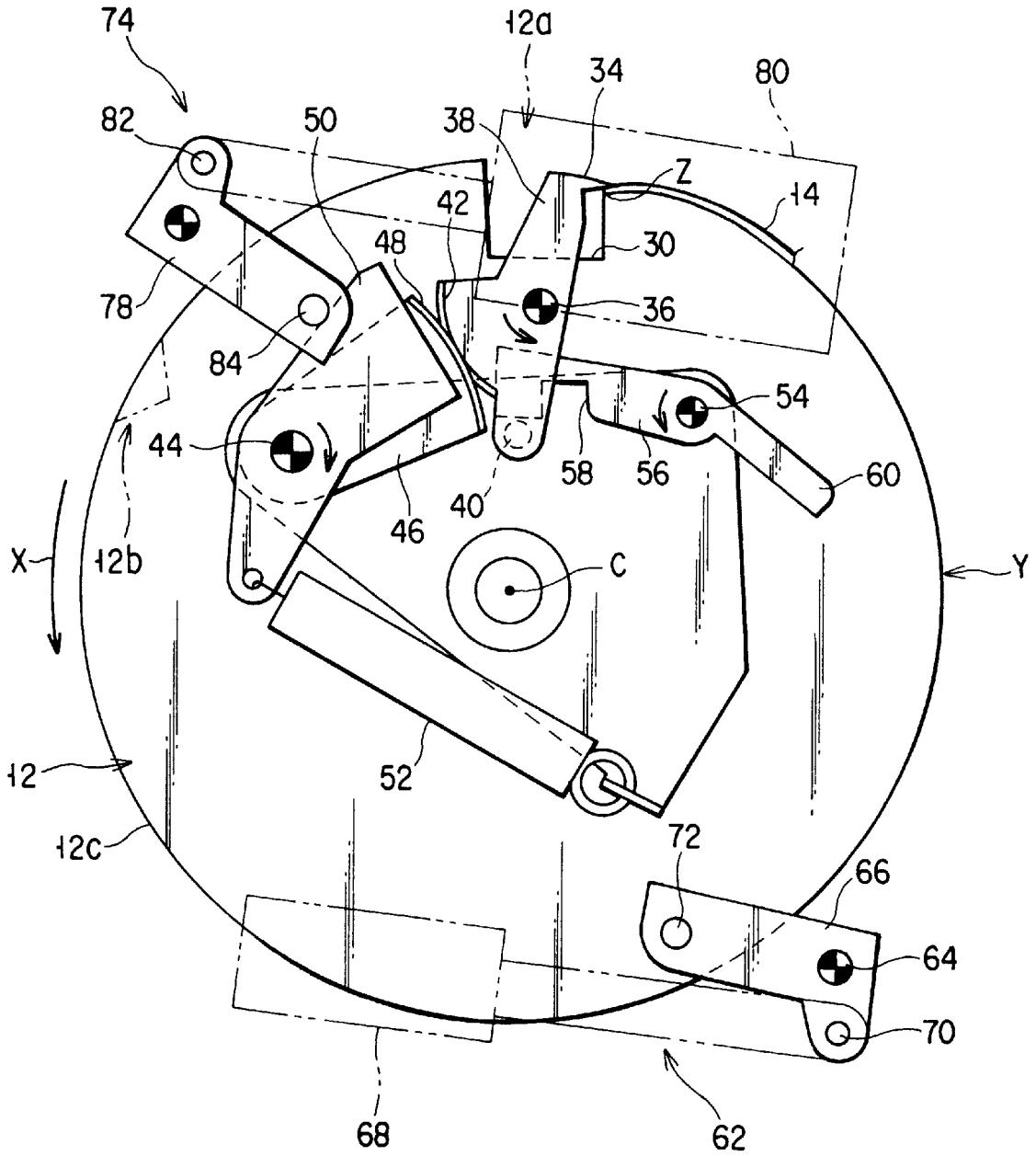

Immediately after the leading end of the paper sheet 14 is held by the leading-end holding hook 34, the drive lever 66 is retracted by the actuator 68 from the operating position (FIGS. 2 and 3) to the rest position (FIG. 4). At the same time, the above described trailing-end holding device 20 (FIG. 1) presses the printing paper sheet 14, the leading end of which has been held by the leading-end holding hook 34, on the periphery 12*c* of the drum 12 so that the portion of the paper sheet 14 ranging from the leading-end holding device 24 to the trailing-end holding device 20 on the periphery 12*c* of the drum 12 is in closely contact with the periphery 12*c* and another portion of the paper sheet 14 corresponding to the trailing-end holding device 20 is curved outward and is lifted from the periphery 12*c* in the radial direction of the drum 12. Immediately after the trailing end of the paper sheet 14 becomes the trailing end of the curved portion and the trailing end of the curved paper sheet 14 has passed under the trailing-end holding device 20, the trailing end of the curved paper sheet 14 is inserted in the trailing-end engaging groove 12*b* on the periphery 12*c* of the drum 12 by the action of the trailing-end holding device 20 and is finally engaged with the trailing-end engaging groove 12*b*.

After one rotation of the drum 12 for making the printing paper sheet 14 be in closely contact with the periphery 12*c* of the drum 12 between the leading-end holding hook 34 and the trailing-end engaging groove 12*b* is finished, the rotation drum 12 further rotates one more time to make an image of a desired color or desired colors on the paper sheet 14 on the periphery 12*c* of the drum 12 by the ink-jet nozzle unit 22*a* of the ink-jet device 22 shown in FIG. 1.

After one more rotation of the drum 12 for making the image on the paper sheet 14, the rotation drum 12 more further rotate one time to remove the paper sheet 14 on which the image has been formed from the periphery 12*c* of the drum 12.

When the rotary drum 12 starts the more further rotation, the actuator 80 of the lock reset mechanism 74 moves the drive lever 78 from the rest position shown in FIGS. 2 and 3 to the operating position shown in FIG. 4 just before the leading-end holding hook 34 arrives at the removing device 24 located in the left side wall facing region around the drum 12 as shown in FIG. 1. Then, the cam member 50 located in the projection position and holding the leading-end holding hook 34 in the overlap position strikes the engaging pin 84 on the other end of the drive lever 78 in the operating position. This makes the cam member 50, together with the sub-swing member 46, turn (clockwise in FIG. 4) from the projection position shown in FIG. 4 to the retracted position shown in FIG. 2 against the force of the urging member 52, hence the leading-end holding hook 34 is moved from the close or overlap position shown in FIG. 4 to the open position shown in FIG. 2. The engaging pin 40 of the swing member 38 having the leading-end holding hook 34 is then engaged with the engaging recess 58 provided in the engaging lever 56 urged by the urging member not shown. Finally, the leading-end holding hook 34 is locked in the open position as shown in FIG. 2 against the force of the urging member 52.

In a residual part of the more further rotation, the printing paper sheet 14 on the periphery 12*c* of the rotary drum 12 is removed from the periphery 12*c* by the removing device 24. The paper sheet 14 is then discharged to the paper sheet discharge auxiliary tray 10*b* or the paper sheet discharge main tray 10*c* by the paper sheet discharge device 26. When the image is formed on a succeeding printing paper sheet 14, the action of the leading-end holding device 12*a* for holding the leading end of the printing paper sheet 14 is restarted as described in detail referring to FIGS. 2 and 3 in a next one rotation of the drum 12.

Next, the structural elements and operations thereof of the trailing-end holding device 20 and the trailing-end engaging groove 12*b* will be described in detail with reference to FIGS. 5 to 7. The holding device 20 is situated in the right side wall facing region (indicated by Y in FIG. 2) around the periphery 12*c* of drum 12, and the engaging groove 12*b* is situated at predetermined second position apart from the predetermined first position on the periphery 12*c* of drum 12 at which the leading-end holding hook 34 of leading-end holding device 12*a* is provided.

Figure 6:
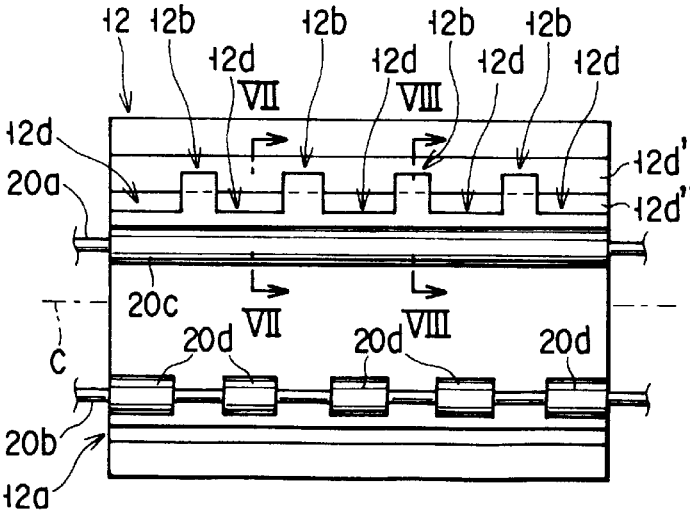
FIG. 6 is an enlarged schematic front view showing the drum, trailing-end engaging grooves and a pair of press rollers of the trailing-end holding device as shown in FIG. 5.
Figures 7, 8:
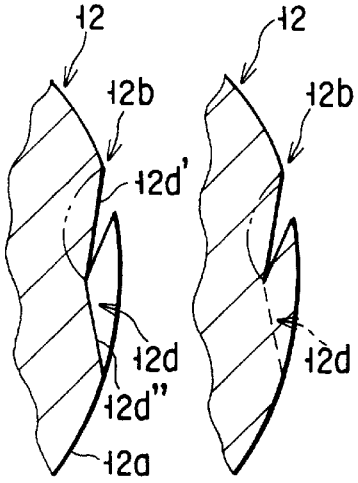
FIG. 7 is a schematic cross-sectional view taken along line VII—VII in FIG. 6, showing a cross section of a non-engaging groove provided between the trailing-end engaging grooves.
FIG. 8 is a schematic cross-sectional view taken along line VIII—VIII in FIG. 6, showing a cross section of one of the trailing-end engaging grooves.

As is shown in FIG. 6, a plurality of trailing-end engaging grooves 12*b* are formed at the predetermined second position on the periphery 12*c* of drum 12 at substantially regular intervals such that the grooves 12*b* are aligned in a straight line extending along and in parallel to the rotational center line c of the rotation shaft of drum 12 (i.e. along the longitudinal direction of drum 12). As is most clearly shown in FIGS. 7 and 8 by solid lines, each of the trailing-end engaging grooves 12*b* has such a cross section that the groove 12*b* extends radially inward of drum 12 as it progresses from the predetermined second position in the direction opposite to the predetermined rotational direction X of drum 12. It should be noted that each of the trailing-end engaging grooves 12*b* may have a concavely cross section, as shown by two-dot-and-dash-lines in FIGS. 7 and 8, retreating radially inward of drum 12 as it progresses from the predetermined second position in the direction opposite to the predetermined rotational direction X of drum 12.

A plurality of trailing-end non-engaging grooves 12*d* are provided between the trailing-end engaging grooves 12*b* along the same straight line on the periphery 12*c* of drum 12. As is clearly shown in FIG. 7, each of the trailing-end non-engaging grooves 12*d* includes an entrance side inclined surface 12*d*′ and an exit side inclined surface 12*d*″. The entrance side inclined surface 12*d*′ is inclined radially inward of drum 21 as it progresses from the predetermined second position in the direction opposite to the predetermined rotational direction X of drum 12, and the entrance side inclined surface 12*d*′ corresponds to a bottom surface of each trailing-end engaging groove 12*b*. The exit side inclined surface 12*d*″ is inclined toward the outer periphery 12*c* of drum 12 as it extends from the inner end of the entrance side inclined surface 12*d*′ in the direction opposite to the predetermined rotational direction X of drum 12.

Figure 5:
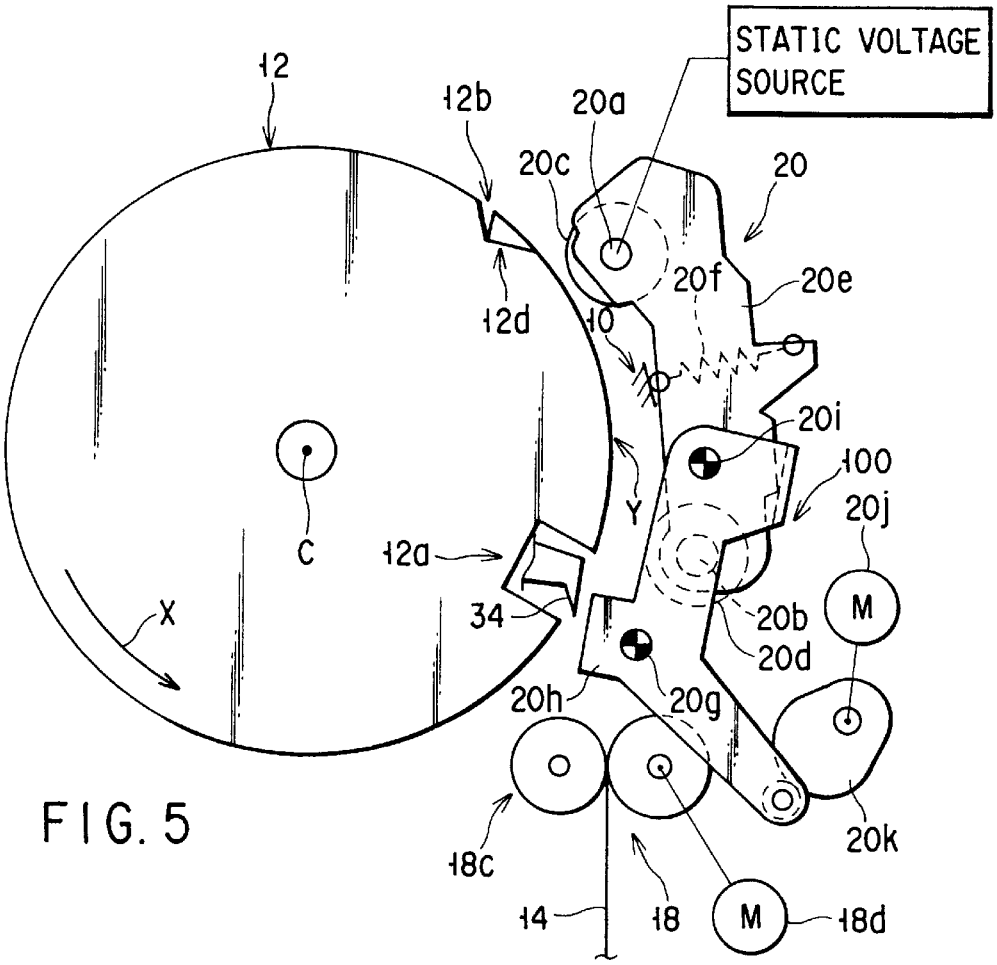
FIG. 5 is an enlarged schematic side view showing structures of the drum in the printing medium winding apparatus according to the embodiment, a plurality of trailing-end engaging grooves provided at second position on the outer periphery of the drum, and a trailing-end holding device.

As is shown in FIG. 5, the trailing-end holding device 20 includes a pair of rotational center shafts 20*a* and 20*b*, a first press roller 20*c* and second press rollers 20*d*. The rotational center shafts 20*a* and 20*b* extend along and in parallel to the rotational center line c of drum 12 on both sides of the predetermined region Y at the periphery 12*c* of drum 12 in the predetermined rotational direction X of drum 12 and the direction opposite thereto. As shown in FIG. 6, the first press roller 20*c* is concentrically and rotatably disposed on the shaft 20*a* and has an outer periphery continuously facing the periphery 12*c* of the drum 12 along the center line c. The second press rollers 20*d* are concentrically and rotatably disposed on the shaft 20*b* and have outer peripheries separated from each other and intermittently facing the periphery 12*c* of the drum 12 along the center line c. The second press rollers 20*d* on the latter rotational center shaft 20*b* are so arranged as to be opposed to locuses of movement of the trailing-end non-engaging grooves 12*d* on the periphery 12*c* of drum 12 when the drum 12 rotates in the predetermined rotational direction X.

The first press roller 20*c* is connected to an electrostatic voltage source through the associated rotational center shaft 20*a*. The voltage source electrifies the printing paper sheet 14 when the paper sheet 14 is fed from the printing paper sheet feeder 18 toward the predetermined right side wall facing region Y around the periphery 12*c* of the drum 12 and is pressed on the periphery 12*c* by the first press roller 20*c*. The electrified paper sheet 14 is in more strongly and closely contact with the periphery 12*c* of the grounded drum 12 by an attraction force of charges generated between the periphery 12*c* of the grounded drum 12 and the electrified paper sheet 14.

Alternatively, the paper sheet 14 may be in more strongly and closely contact with the periphery 12*c* of the grounded drum 12 by an attraction force of charges generated between the periphery 12*c* and the paper sheet 14 by grounding the first press roller 20*c* and connecting the electrostatic voltage source to the periphery 12*c* of the drum 12.

As is shown in FIG. 5, both ends of each of the paired rotational center shafts 20*a* and 20*b* are supported on a movable frame 20*e*. The frame 20*e* is urged toward the periphery 12*c* of drum 12 by an urging member 20*f*, such as an extension coil spring, provided between the housing 10 and the movable frame 20*e*. One end portion of a swing lever 20*h* provided on a rotational center shaft 20*g* rotatably supported on the housing 10 is rotatably coupled by means of a rotational center shaft 20*i* to the movable frame 20*e* between the paired rotational center shafts 20*a* and 20*b* in the movable frame 20*e*. The other end portion of the swing lever 20*h* is brought into contact with a cam plate 20*k* by an urging force of the urging member 20*f* which is transmitted to the swing lever 20*h* from the movable frame 20*e* via the rotational center shaft 20*i* at the one end portion of the swing lever 20*h*. The cam plate 20*k* is selectively rotated by a motor 20*j* supported on the housing 10.

Until the printing paper 14 is fed from the wait roller pair 18*c* of printing paper feeder 18 toward the predetermined region Y around the outer periphery 12*c* of drum 12, the other end portion of the swing lever 20*h* of trailing-end holding device 20 is pressed by a most projecting portion of the cam plate 20*k*. As a result, the swing lever 20*h* moves the frame 20*e* by means of the rotational center shaft 20*i* at the one end portion of lever 20*h* away from the periphery 12*c* of drum 12 against the urging force of urging means 20*f*. During this time, the movable frame 20*e* is urged by the urging member 20*f* to rotate on the rotational center shaft 20*i* toward the periphery 12*c* of drum 12. However, this rotation is prevented by a contact between the one end portion of the swing lever 20*h* and the movable frame 20*e*. At this time, the distance between the first press roller 20*c* and the periphery 12*c* of drum 12 is set to be smaller than the distance between the second press rollers 20*d* and the periphery 12*c* of drum 12.

Specifically, in this embodiment, when the cam plate 20*k* is rotated, the first and second press rollers 20*c* and 20*d* of the trailing-end holding device 20 are put in contact with and separated from the periphery 12*c* of drum 12 by means of the swing lever 20*h*. The cam plate 20*k*, swing lever 20*h*, movable frame 20*e* and urging member 20*f* are included in a contact/separation device 100 for the aforementioned selective contact and separation.

FIG. 5 also shows a motor 18*d* connected to the wait roller pair 18*c* of printing paper feeder 18 for sending out the printing paper sheet 14 at a speed slightly higher than the circumferential speed of the periphery 12*c* of drum 12.

The operations of the trailing-end engaging grooves 12*b* and trailing-end holding device 20 having the above structures will now be described with reference to FIGS. 9A to 9H.

Figure 9A:
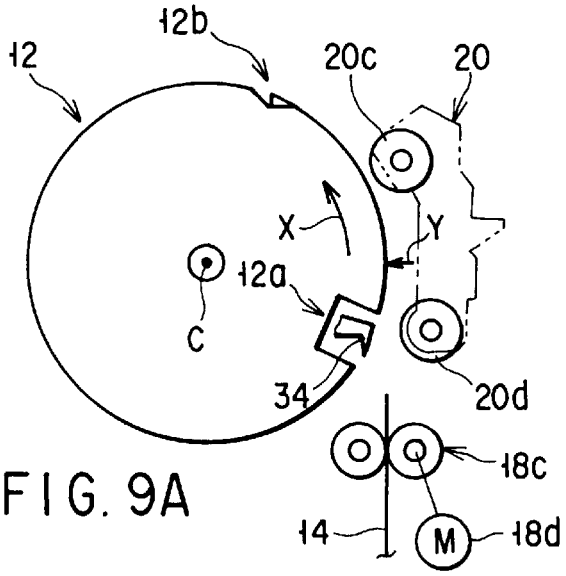
FIGS. 9A, 9B, 9C, 9D, 9E, 9F, 9G and 9H are schematic side views of the trailing-end holding device in the printing medium winding apparatus according to the embodiment in various states of an operation of the holding device while the drum is rotated at one time to hold the printing medium thereon.

The drum 12 starts to make one rotation at a predetermined circumferential speed in the predetermined rotational direction X of drum 12, thereby to wind the printing paper sheet 14 on the periphery 12*c* of drum 12. When the leading-end holding device 12*a* provided on the periphery 12*c* of drum 12 approaches the predetermined region Y around the periphery 12*c* of drum 12 and the leading-end holding hook 34 has been set in the open position as has been described above with reference to FIG. 3, the wait roller pair 18*c* sends out the printing paper sheet 14 toward the predetermined region Y along the movement of the leading-end holding device 12*a*. This state is illustrated in FIG. 9A.

At the predetermined region Y, the leading end of the printing paper sheet 14 comes in contact with the leading-end holding hook 34 in the open position of the leading-end holding device 12*a*. In addition, as has been described above with reference to FIG. 3, the leading-end holding hook 34 cooperates with the predetermined first position Z (see FIG. 3) of the periphery 12*c* of drum 12, thereby clamping and holding the printing paper sheet 14.

At the same time as the wait roller pair 18*c* has sent out the printing paper sheet 14, the cam plate 20*k* (see FIG. 5) for the trailing-end holding device 20 starts to rotate at a predetermined speed in a predetermined direction. As a result, the trailing-end holding device 20 is moved toward the periphery 12*c* of drum 12 by the urging force of urging member 20*f* (see FIG. 5). Before the leading-end holding hook 34 has passed under the first press roller 20*c*, the first press roller 20*c* is first pressed on the periphery 12*c* of drum 12. A predetermined time has passed after the contact of the first press roller 20*c* on the periphery 12*c* of the drum 12, the paper sheet 14 the leading end of which has been held by the leading end holding device 12*a* is pressed on and in closely contact with the periphery 12*c* of the drum 12. FIG. 9B shows this state.

Then, the second press rollers 20*c* of trailing-end holding device 20 is pressed on the periphery 12*c* of drum 12. FIG. 9C shows this state. In this state, a portion 14*a* of printing paper sheet 14 on the periphery 12*c* of drum 12 between the leading-end holding hook 34 and the first press roller 20*c* of rear-end holding device 20 is pressed on the periphery 12*c* of drum 12 by the first press roller 20*c* and attracted on the periphery 12*c* by electrostatic voltage applied from the electrostatic voltage source to the first press roller 20*c*. Further in this time, since the printing paper sheet 14 is sent out from the wait roller pair 18*c* at the speed slightly higher than the predetermined circumferential speed of the periphery 12*c* of drum 12, a portion 14*b* of printing paper sheet 14 on the periphery 12*c* of drum 12 between the first press roller 20*c* and second press rollers 20*d* of trailing-end holding device 20 is outwardly curved and lifted from the periphery 12*c*, as shown in FIG. 9C.

Specifically, in the present invention, the combination of the freely rotatable first and second press rollers 20*c* and 20*d* of trailing-end holding device 20 and the wait roller pair 18*c* for sending out the printing paper sheet 14 at the speed slightly higher than the predetermined circumferential speed of the periphery 12*c* of drum 12, as mentioned above, constitutes a printing paper lifting device for lifting the printing paper sheet 14 from the periphery 12*c* of drum 12 at the trailing-end holding device 20.

Figure 9D:
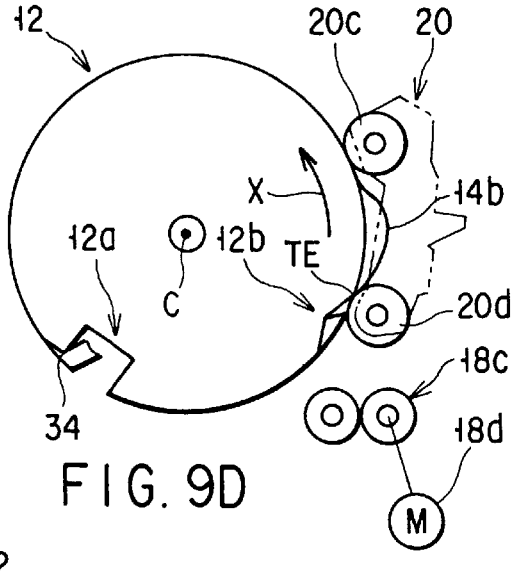
Figure 9B:
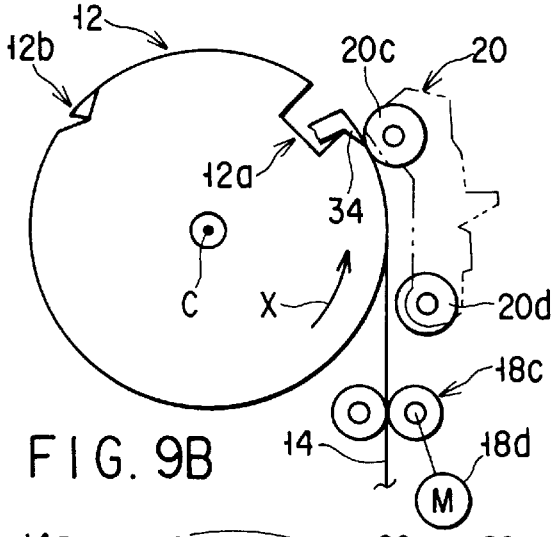
Figure 9F:
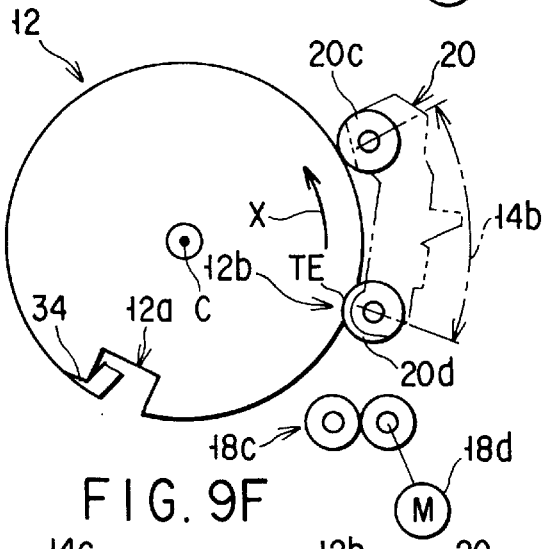
Figure 9C:
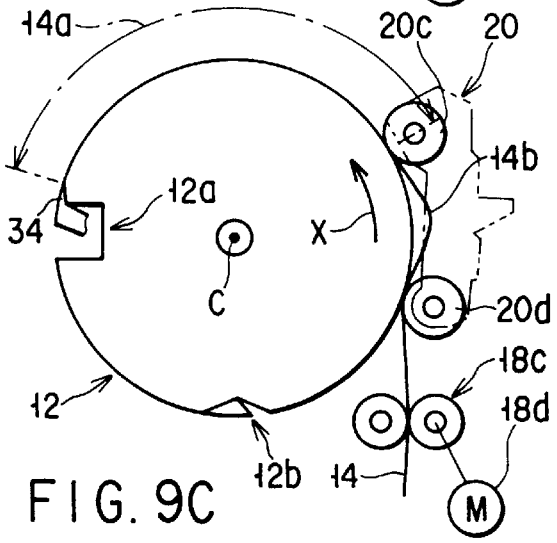
Figure 9H:
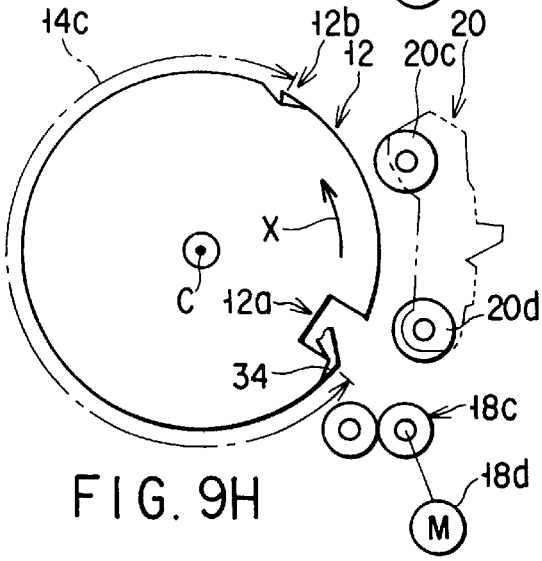
Figure 9E:
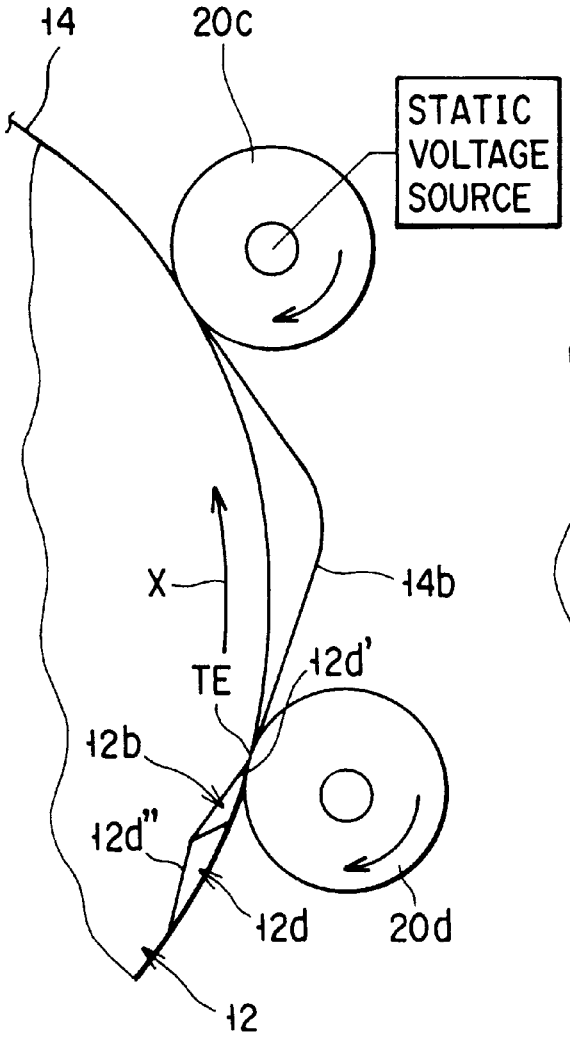

While the drum 12 continues its rotation and the trailing-end engaging grooves 12*b* on the periphery 12*c* of drum 12 have reached the trailing-end holding device 20, the trailing end of the portion 14*b* of printing paper sheet 14, which is lifted between the first and second press rollers 20*c* and 20*d* of trailing-end holding device 20, becomes a trailing end TE of the paper sheet 14 and the angle of inclination of the trailing end TE with respect to the periphery 12*c* becomes substantially equal to the angle of inclination of the bottom surface of each trailing-end engaging groove 12*b* and the entrance side inclined surface 12*d'* of each trailing-end non-engaging groove 12*d* with respect to the periphery 12*c*, as shown in FIG. 9D and FIG. 9E which is a partial enlargement of FIG. 9D.

Figure 9G:
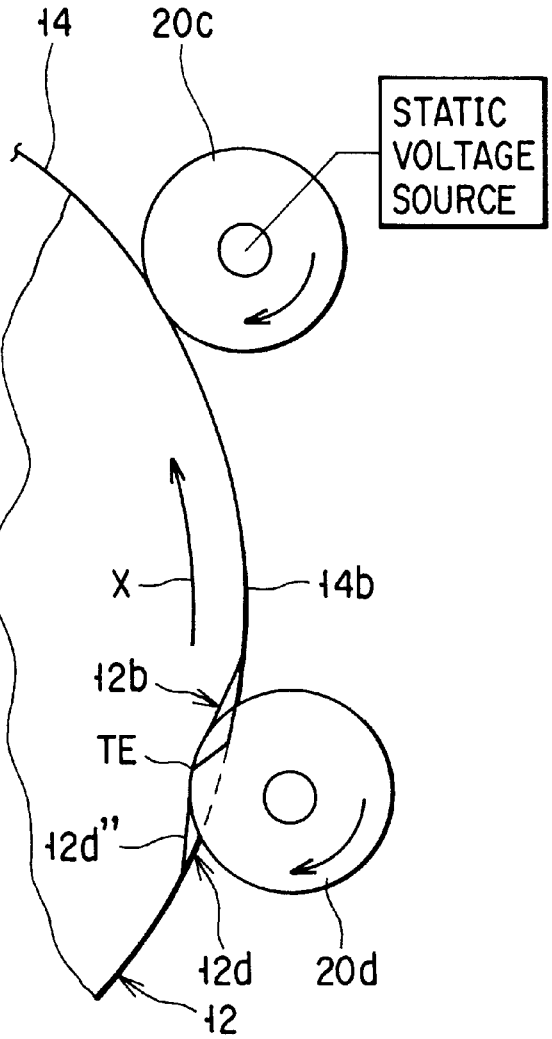

While the drum 12 continues its rotation, the second press rollers 20*d* of trailing-end holding device 20, as shown in FIG. 9F and FIG. 9G which is a partial enlargement of FIG. 9F, enter the entrance side inclined surfaces 12*d'* of the trailing-end non-engaging grooves 12*d* while they are pressing the trailing end TE of printing paper sheet 14. As a result, the trailing end TE is inserted into the trailing-end engaging grooves 12*b* adjoining the trailing-end non-engaging grooves 12*d* and engaged in the engaging grooves 12*b* in the radially outward direction of drum 12.

Immediately after the trailing end engaging grooves 12*b*, with which the trailing end TE of the paper sheet 14 is engaged, has passed under the first press roller 20*c* of the leading end holding device 20, the trailing-end holding device 20 is moved away from the periphery 12*c* of drum 12 by the function of the cam plate 20*k* shown in FIG. 5, and the first and second press rollers 20*c* and 20*d* of trailing-end holding device 20 are separated from the periphery 12*c*. This state is shown in FIG. 9H.

In this state, inversely to the state of FIG. 9B in which the first and second press rollers 20*c* and 20*d* of trailing-end holding device 20 are pressed on the periphery 12*c*, the second press rollers 20*d* are firstly separated from the periphery 12*c* and then the first press rollers 20*c* is separated from the periphery 12*c*.

Alternatively, the first press roller 20*c* of the trailing end holding device 20 may firstly be separated from the periphery 12*c* of the drum 12 before the trailing end engaging grooves 12*b*, with which the trailing end of the paper sheet 14 has been engaged, is passed under the first press roller 20*c*.

Following the above, the drum 12 starts a further one rotation in order to form an image on the printing paper sheet 14 wound around the periphery 12*c* of drum 12, as described above, with use of the ink-jet unit 22 (see FIG. 1).

The distance on the periphery 12*c* of drum 12 between the leading-end holding hook 34 of leading-end holding device 12*a* and the trailing-end engaging grooves 12*b* in the direction opposite to the rotational direction X of drum 12 is substantially equal to the length of the portion 14*c* of printing paper 14 wound and held on the periphery 12*c* between the holding hook 34 and the engaging grooves 12*b*. Thus, while the drum 12 is rotating for image formation, the printing paper sheet 14 including its leading and trailing ends is not lifted from the periphery 12*c* of drum 12.

Figure 10A:
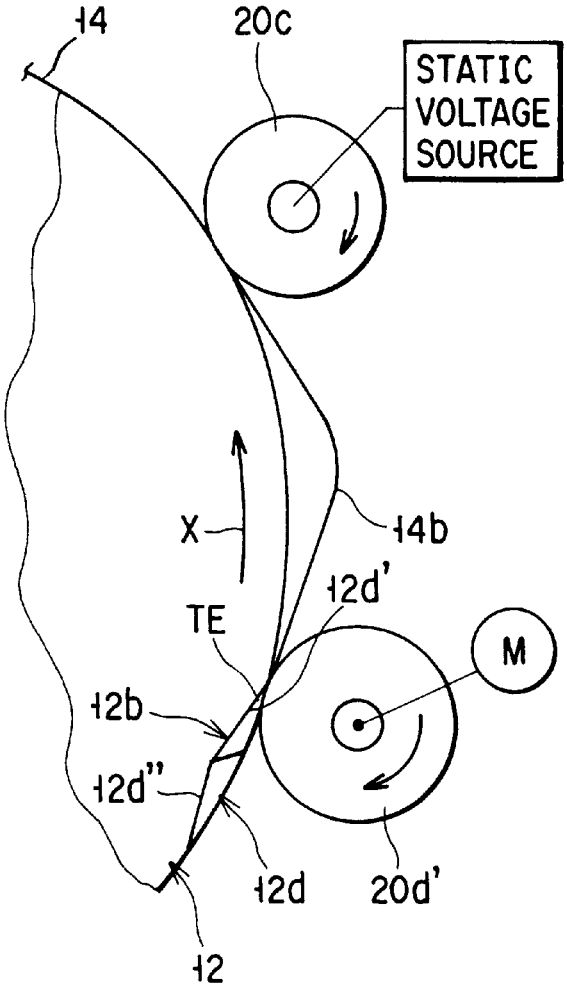
FIGS. 10A and 10B are enlarged schematic side views showing principal states of an operation of a modification of the trailing-end holding device in the printing-medium winding apparatus according to the embodiment of the invention.
Figure 10B:
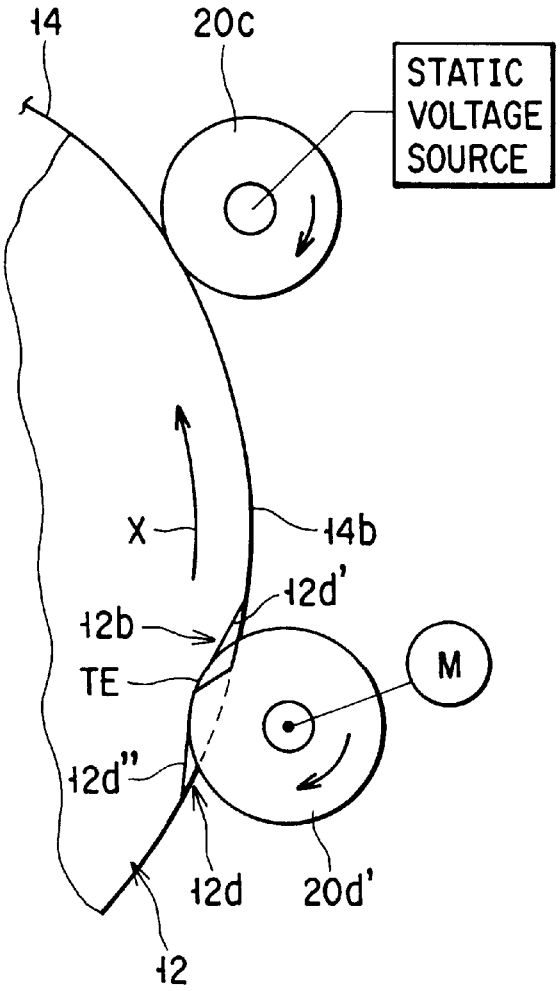

Referring to FIGS. 10A and 10B, a modification of the printing medium winding apparatus according to the embodiment of the invention will now be described.

The modification differs from the embodiment in that the wait roller pair 18*c* of printing paper feeder 18 shown in FIG. 1 sends out the printing paper sheet 14 at a speed substantially equal to the circumferential speed of the periphery of drum 12, and in this modification a lifting of printing paper sheet 14 from the periphery 12*c* of drum 12 in the trailing-end holding device 20 is not caused by a difference between the speed at which the wait roller pair 18*c* sends out the printing paper sheet 14 and the circumferential speed of the periphery of drum 12.

In this modification a relative speed of the first press roller 20*c* of the trailing end holding device 20 to the circumferential speed of the periphery 12*c* of the drum 12 is set silatively small, and a relative speed of the second press rollers 20*d* of the trailing end holding device 20 to the circumferential speed of the periphery 12*c* of the drum 12 is set relatively large. And, a lifting of the printing paper sheet 14 from the periphery 12*c* of the drum 12 in the trailing end holding device 20 is generated by a different between the relative speed of the first press roller 20*c* and the relative speed of the second press roller 20*d*. Concretely, the first press roller 20*c* of the trailing-end holding device 20 is constituted as a folling roller which is freely rotatable, and the second press rollers 20*d'* of trailing-end holding device 20 are forcibly rotated by rotational speed control device such as a motor in a direction opposite to the predetermined rotational direction X of drum 12 at a circumferential speed slightly higher than the circumferential speed of the periphery 12*c* of the drum 12. More specifically, the circumferential speed of the periphery of second press rollers 20*d'* needs to be slightly higher than that of the periphery of first press roller 20*c*.

In this modification, the leading end of the printing paper sheet 14, which is fed from the wait roller pair 18*c* to the drum at the speed substantially equal to the circumferential speed of the periphery 12*c* of drum 12 rotating in the predetermined direction X, is held by the leading-end holding device 12*a* on the periphery 12*c* of drum 12 at the predetermined region Y around the periphery 12*c* of drum 12, similarly with the above described embodiment. Then, the printing paper sheet 14 is pressed on the periphery 12*c* of drum 12 by the first and second press rollers 20*c* and 20*d'* of trailing-end holding device 20. Thereby, the printing paper sheet 14 is pressed on and in close contact with the periphery 12*c* of drum 12 between the leading-end holding device 12*a* and the trailing-end holding device 20, as in the above described embodiment. Further, the printing paper sheet 14 between the first and second press rollers 20*c* and 20*d'* of the trailing-end holding device 20 is curved to be projected outward and lifted from the periphery 12*c* due to the difference between the relative speed of the first press roller 20*c* and that of the second press rollers 20*d'*.

That is to say, in this modification, the combination of the first and second press rollers 20*c* and 20*d*, the relative speeds of which to the circumferential speed of the periphery 12*c* of the drum 12 are so set as described above, in the trailing-end holding device 20 constitute the printing medium lifting device for lifting the printing paper sheet 14, the leading end of which has been held by the loading-end holding device 12*a* on the periphery 12*c* of the drum 12, by projecting the paper sheet 14 from the periphery 12*c* to be curved radially outwardly the trailing-end holding device 20.

As is shown in FIG. 10A, when a trailing end of the portion of printing paper sheet 14, which is outwardly curved between the first and second press rollers 20*c* and 20*d'*, has become the trailing end TE of printing paper sheet 14, the trailing-end engaging grooves 12*b* on the periphery 12*c* of drum 12 reach the second press rollers 20*d'* and the angle of inclination of the trailing end TE of the curved printing sheet 14 with respect to the periphery 12*c* drum 12 becomes substantially equal to the angle of inclination of the bottom surface of each trailing-end engaging groove 12*b* and the entrance side inclinated surface 12*d* of each trailing-end non-engaging groove 12*d* with respect to the periphery 12*c*. When the drum 12 further continue its rotation, the second press rollers 20*d'* of trailing-end holding device 20, as shown in FIG. 10B, enter the entrance side inclined surfaces 12*d* of the trailing-end non-engaging grooves 12*d* along with the trailing edge TE of printing paper sheet 14. As a result, the trailing end TE is inserted and engaged in the trailing-end engaging grooves 12*b*.

In the above modification, the first press roller 20*c* of the trailing-end holding device 20 may be moved toward the periphery 12*c* of drum 12 to press the printing paper sheet 14 on the periphery 12*c* either before or after the leading end of the paper sheet 14 is passed under the first press roller 20*c* of the trailing-end holding device 20. However, the former timing is superior to the latter timing in a degree of contact of the paper sheet 14 to the periphery 12*c* of the drum 12 (that is, a quality of the image formed on the paper sheet 14).

Further, in the above modification, the first press roller 20*c* may be separated from the periphery 12*c* of the drum 12 either before or after the trailing end TE of the printing paper sheet 14 which has been engaged with the leading-end engaging groove 12*b* passes under the first press roller 20*c* of the trailing-end holding device 20. However, the former timing is superior to the latter timing in a degree of contact of the paper sheet 14 to the periphery 12*c* of the drum 12 (that is, a quality of the image formed on the paper sheet 14).

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A wrapping apparatus for wrapping a printing medium on an outer periphery of a drum that is rotatable in a predetermined rotational direction at a predetermined peripheral speed, said wrapping apparatus comprising:

a leading-end holding device provided at a first position on the outer periphery of the drum, said leading-end holding device holding at the first position a leading end of the printing medium fed toward the outer periphery of the drum while the drum is rotated;

a plurality of trailing-end engaging grooves formed on the outer periphery of the drum at a second position positioned apart from the leading-end holding device in a direction opposite to the predetermined rotational direction of the drum at a distance equal to a length of the printing medium in the predetermined rotational direction, said trailing-end engaging grooves being separated from each other on a straight line along a rotation shaft of the drum and extending radially inward of the drum as they progress from the second position in the direction opposite to the predetermined rotational direction of the drum;

a plurality of non-engaging grooves formed between the trailing-end engaging grooves on the outer periphery of the drum on the same straight line along the rotation shaft of the drum; and a printing medium lifting device including a first press roller and a second press roller located away from the first press roller in the direction opposite to the predetermined rotational direction of the drum, said first and second press rollers pressing the printing medium on the outer periphery of the drum at two mutually circumferentially separated positions on the outer periphery while the leading end of the printing medium is held by the leading-end holding device on the outer periphery of the drum, such that the printing medium is kept in close contact with the outer periphery of the drum between the leading-end holding device and the first press roller and is lifted from the outer periphery of the drum between the first and second press rollers, and such that a trailing end of the printing medium is inserted into the trailing-end engaging grooves when the drum rotates in the predetermined rotational direction.

2. The wrapping apparatus according to claim 1, wherein the printing medium lifting device includes a printing medium feeding device which feeds the printing medium along a moving direction of the first position on the outer periphery of the drum at a speed higher than the predetermined peripheral speed of the drum, and which continues to feed the printing medium toward the outer periphery of the drum even after the leading end of the printing medium is held by the leading-end holding device on the outer periphery of the drum.

3. The wrapping apparatus according to claim 2, further comprising a voltage source which applies voltage to the first press roller of the printing medium lifting device, so that the printing medium is attracted to the outer periphery of the drum by a static attractive force generated by the voltage when the printing medium is pressed on the outer periphery of the drum by the first press roller.

4. The wrapping apparatus according to claim 2, wherein the printing medium lifting device includes a roller contacting/separating device which separates the first and second press rollers of the printing medium lifting device from the outer periphery of the drum after the trailing end of the printing medium is inserted into the trailing-end engaging grooves.

5. The wrapping apparatus according to claim 2, wherein the printing medium lifting device includes a roller contacting/separating device which controls the first and second press rollers to contact with and separate from the outer periphery of the drum in a manner such that the first press roller contacts with the outer periphery of the drum earlier than the second press roller.

6. The wrapping apparatus according to claim 1, wherein:

the first press roller of the printing medium lifting device comprises one roller section, and has a continuous outer periphery which continuously faces the outer periphery of the drum in a direction aligned with rotation shaft of the drum; and the second press roller of the printing medium lifting device comprises a plurality of roller sections separated from each other along the rotation shaft of the drum, and has an outer periphery which intermittently faces the outer periphery of the drum at a plurality of positions corresponding to the plurality of non-engaging grooves.

7. The wrapping apparatus according to claim 1, wherein each of the non-engaging grooves includes an entrance side surface which is inclined radially inward of the drum from the outer periphery of the drum along the direction opposite to the predetermined rotational direction of the drum, and an exit side surface which is inclined radially outward of the drum from an inner end of the entrance side surface to the periphery of the drum.

8. A wrapping apparatus for wrapping a printing medium on an outer periphery of a drum that is rotatable in a predetermined rotational direction at a predetermined peripheral speed, said wrapping apparatus comprising:

a leading-end holding device provided at a first position on the outer periphery of the drum, said leading-end holding device holding at the first position a leading end of the printing medium fed toward the outer periphery of the drum while the drum is rotated;

a plurality of trailing-end engaging grooves formed on the outer periphery of the drum at a second position positioned apart from the leading-end holding device in a direction opposite to the predetermined rotational direction of the drum at a distance equal to a length of the printing medium in the predetermined rotational direction, said trailing-end engaging grooves being separated from each other on a straight line along a rotation shaft of the drum and extending radially inward of the drum as they progress from the second position in the direction opposite to the predetermined rotational direction of the drum;

a plurality of non-engaging grooves formed between the trailing-end engaging grooves on the outer periphery of the drum on the same straight line along the rotation shaft of the drum; and a printing medium lifting device including a first press roller and a second press roller located away from the first press roller in the direction opposite to the predetermined rotational direction of the drum, said first and second press rollers pressing the printing medium on the outer periphery of the drum at two mutually circumferentially separated positions on the outer periphery while the leading end of the printing medium is held by the leading-end holding device on the outer periphery of the drum;

wherein said printing medium lifting device further includes a printing medium feeding device which feeds printing medium along a moving direction of the first position on the outer periphery of the drum at a speed substantially equal to the predetermined peripheral speed of the drum, and a second press roller rotating device which rotates the second press roller at a peripheral speed higher than the predetermined peripheral speed of the drum in the direction opposite to the predetermined rotational direction of the drum, such that the printing medium is kept in close contact with the outer periphery of the drum between the leading-end holding device and the first press roller and is lifted from the outer periphery of the drum between the first and second press rollers, and such that a trailing end of the printing medium is inserted into the trailing-end engaging grooves when the drum rotates in the predetermined rotational direction.

9. The wrapping apparatus according to claim 8, further comprising a voltage source which applies voltage to the first press roller of the printing medium lifting device, so that the printing medium is attracted to the outer periphery of the drum by a static attractive force generated by the voltage when the printing medium is pressed on the outer periphery of the drum by the first press roller.

10. The wrapping apparatus according to claim 8, wherein the printing lifting device includes a roller contacting/separating device which: (i) holds the first and second press rollers and brings the first and second press rollers into contact with the outer periphery of the drum to press the printing medium on the outer periphery when the leading end of the printing medium fed by the printing medium feeding device is held by the leading-end holding device on the periphery of the drum, (ii) separates the first and second press rollers from the outer periphery of the drum when the trailing end of the printing medium is inserted into the trailing-end engaging grooves, and (iii) keeps the first and second press rollers separated from the outer periphery of the drum while the leading end is held by the leading-end holding device and the trailing end of the printing medium is inserted into the trailing-end engaging grooves on the outer periphery of the drum.

11. The wrapping apparatus according to claim 10, wherein the roller contacting/separating device holds the first and second press rollers in a manner such that a distance between the first press roller and the outer periphery of the drum is smaller than a distance between the second press roller and the outer periphery of the drum while the first and second press rollers are separated from the outer periphery of the drum, and controls the first press roller to come into contact with the outer periphery of the drum earlier than the second press roller.

12. The wrapping apparatus according to claim 8, wherein:

the first press roller of the printing medium lifting device comprises one roller section, and has a continuous outer periphery which continuously faces the outer periphery of the drum in a direction aligned with rotation shaft of the drum; and the second press roller of the printing medium lifting device comprises a plurality of roller sections separated from each other along the rotation shaft of the drum, and has an outer periphery which intermittently faces the outer periphery of the drum at a plurality of positions corresponding to the plurality of non-engaging grooves.

13. The wrapping apparatus according to claim 8, wherein each of the non-engaging grooves includes an entrance side surface which is inclined radially inward of the drum from the outer periphery of the drum along the direction opposite to the predetermined rotational direction of the drum, and an exit side surface which is inclined radially outward of the drum from an inner end of the entrance side surface to the periphery of the drum.

14. An ink-jet printer comprising:

a drum having a rotation shaft, said drum being rotatable in a predetermined rotational direction at a predetermined peripheral speed;

a printing medium feeding device which feeds a printing medium toward an outer periphery of the drum while the drum is rotated;

a leading-end holding device provided at a first position on the outer periphery of the drum, said leading-end holding device holding at the first position a leading end of the printing medium fed toward the outer periphery of the drum while the drum is rotated;

a plurality of trailing-end engaging grooves formed on the outer periphery of the drum at a second position positioned apart from the leading-end holding device in a direction opposite to the predetermined rotational direction of the drum at a distance equal to a length of the printing medium in the predetermined rotational direction, said trailing-end engaging grooves being separated from each other on a straight line along a rotation shaft of the drum and extending radially inward of the drum as they progress from the second position in the direction opposite to the predetermined rotational direction of the drum;

a plurality of non-engaging grooves formed between the trailing-end engaging grooves on the outer periphery of the drum on the same straight line along the rotation shaft of the drum;

a printing medium lifting device including a first press roller and a second press roller located away from the first press roller in the direction opposite to the predetermined rotational direction of the drum, said first and second press rollers pressing the printing medium on the outer periphery of the drum at two mutually circumferentially separated positions on the outer periphery while the leading end of the printing medium is held by the leading-end holding device on the outer periphery of the drum, such that the printing medium is kept in close contact with the outer periphery of the drum between the leading-end holding device and the first press roller and is lifted from the outer periphery of the drum between the first and second press rollers, and such that a trailing end of the printing medium is inserted into the trailing-end engaging grooves when the drum rotates in the predetermined rotational direction;

an ink-jet device which forms an image on the printing medium while the leading and trailing ends of the printing medium are held by the leading-end holding device and the trailing-end engaging grooves, respectively, on the outer periphery of the drum and the drum is rotated in the predetermined rotational direction;

a removing device which removes the printing medium from the outer periphery of the drum immediately after the image has been formed on the printing medium by the ink-jet printer and the leading end of the printing medium has been released by the leading-end holding device; and a printing medium discharge device which discharges the printing medium to a predetermined position independent of the drum after the printing medium has been removed from the outer periphery of the drum by the removing device.

15. The ink jet printer according to claim 14, wherein the printing lifting device includes a roller control mechanism which, using a cam, controls the first and second press rollers to: (i) contact with the outer periphery of the drum to press the printing medium on the outer periphery when the leading end of the printing medium fed by the printing medium feeding device is held by the leading-end holding device on the periphery of the drum, (ii) separates the first and second press rollers from the outer periphery of the drum when the trailing end of the printing medium is inserted into the trailing-end engaging grooves, and (iii) keeps the first and second press rollers separated from the outer periphery of the drum while the leading end is held by the leading-end holding device and the trailing end of the printing medium is inserted into the trailing-end engaging grooves on the outer periphery of the drum.

16. The ink jet printer according to claim 15, further comprising a voltage source which applies voltage to the first press roller of the printing medium lifting device, so that the printing medium is attracted to the outer periphery of the drum by a static attractive force generated by the voltage when the printing medium is pressed on the outer periphery of the drum by the first press roller.

17. The ink jet printer according to claim 14, wherein the first press roller of the printing medium lifting device comprises one roller section, and has a continuous outer periphery which continuously faces the outer periphery of the drum in a direction aligned with rotation shaft of the drum; and the second press roller of the printing medium lifting device comprises a plurality of roller sections separated from each other along the rotation shaft of the drum, and has an outer periphery which intermittently faces the outer periphery of the drum at a plurality of positions corresponding to the plurality of non-engaging grooves.

18. The ink jet printer according to claim 14, wherein each of the non-engaging grooves includes an entrance side surface which is inclined radially inward of the drum from the outer periphery of the drum along the direction opposite to the predetermined rotational direction of the drum, and an exit side surface which is inclined radially outward of the drum from an inner end of the entrance side surface to the periphery of the drum.

* * * * *